US010368574B2

(12) United States Patent
Mironov et al.

(10) Patent No.: US 10,368,574 B2
(45) **Date of Patent: *Aug. 6, 2019**

(54) METHOD FOR COMBINING SEGMENTS OF A SMOKING ARTICLE AND COMBINER FOR COMBINING SUCH SEGMENTS

(71) Applicant: PHILIP MORRIS PRODUCTS S.A., Neuchatel (CH)

(72) Inventors: Oleg Mironov, Neuchatel (CH); Andrea Carraro, Ins (CH); Christopher Grant, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 424 days.

This patent is subject to a terminal disclaimer.

(21) Appl. No.: 14/787,911

(22) PCT Filed: May 21, 2014

(86) PCT No.: PCT/EP2014/060385

§ 371 (c)(1),
(2) Date: Oct. 29, 2015

(87) PCT Pub. No.: WO2014/187839

PCT Pub. Date: Nov. 27, 2014

(65) Prior Publication Data

US 2016/0073684 A1 Mar. 17, 2016

(30) Foreign Application Priority Data

May 21, 2013 (EP) ..... 13168602

(51) Int. Cl.
*A24C 5/02* (2006.01)
*A24F 47/00* (2006.01)
(Continued)

(52) U.S. Cl.
CPC ..... *A24C 5/02* (2013.01); *A24C 5/39* (2013.01); *A24C 5/474* (2013.01); *A24F 47/006* (2013.01); *A24D 3/0287* (2013.01)

(58) Field of Classification Search
CPC ..... A24F 47/006
See application file for complete search history.

(56) References Cited

U.S. PATENT DOCUMENTS 4,197,864 A * 4/1980 Molins ..... A24C 5/478 131/94
4,290,518 A * 9/1981 Dyett ..... A24C 5/478 198/450

(Continued)

FOREIGN PATENT DOCUMENTS

CN 2305865 2/1999
CN 1575673 2/2005

(Continued)

OTHER PUBLICATIONS

PCT Search Report and Written Opinion for PCT/EP2014/060385 dated Jun. 25, 2014 (7 pages).

*Primary Examiner* — Eric Yaary
(74) *Attorney, Agent, or Firm* — Mueting, Raasch & Gebhardt, P.A.

(57) ABSTRACT

A method for combining segments of a smoking article, comprises the steps of: —providing a group of segments having a heat source (10; 20) and an aerosol-forming substrate (11; 21) the aerosol-forming substrate (10; 20) being arranged such that a remote end (112; 212) thereof faces away from the heat source (10; 20) while a near end (112; 211) thereof abuts the heat source (10; 20), —feeding an airflow directing truncated hollow cone (13; 23) having a widest end (131; 231) and a truncated narrowest end (130; 230) such that the truncated narrowest end (130; 230) is arranged to face the remote end (112; 212) of the aerosol- (Continued)

forming substrate (11; 21), and —moving the truncated hollow cone (13; 23) towards the remote end (112; 212) of the aerosol-forming substrate (11; 21) to abut the remote end (112; 212) thereof or to extend into an indentation (113; 213) in the remote end (112; 212) thereof.

19 Claims, 5 Drawing Sheets

(51) Int. Cl.

| | |
|---|---|
| ***A24C 5/39*** | (2006.01) |
| ***A24C 5/47*** | (2006.01) |
| *A24D 3/02* | (2006.01) |

(56) References Cited

U.S. PATENT DOCUMENTS

| | | | | |
|---|---|---|---|---|
| 4,445,519 | A * | 5/1984 | Hinz | A24C 5/471 131/94 |
| 4,886,077 | A | 12/1989 | Hinzmann | |
| 2001/0032651 | A1* | 10/2001 | Dombek | A24C 5/471 131/281 |
| 2005/0016550 | A1 | 1/2005 | Katase | |
| 2009/0065011 | A1* | 3/2009 | Maeder | A24F 47/006 131/194 |

FOREIGN PATENT DOCUMENTS

| | | |
|---|---|---|
| EP | 2210509 | 7/2010 |
| WO | WO 2011/139730 | 11/2011 |

* cited by examiner

METHOD FOR COMBINING SEGMENTS OF A SMOKING ARTICLE AND COMBINER FOR COMBINING SUCH SEGMENTS

This application is a U.S. National Stage Application of International Application No. PCT/EP2014/060385, filed May 21, 2014, which was published in English on Nov. 27, 2014 as International Patent Publication WO 2014/187839 A1. International Application No. PCT/EP2014/060385 claims priority to European Application No. 13168602.4 filed May 21, 2013.

The present invention relates to a method for combining segments of a smoking article and to a combiner for combining such segments.

A number of smoking articles in which tobacco is heated rather than combusted have been proposed in the art. One aim of such 'heated smoking articles' is to reduce known harmful smoke constituents of the type produced by the combustion and pyrolytic degradation of tobacco in conventional cigarettes. For example, in one known type of heated smoking article, an aerosol is generated by the transfer of heat from a combustible heat source to an aerosol-forming substrate located downstream of the combustible heat source. During smoking, volatile compounds are released from the aerosol-forming substrate by heat transfer from the combustible heat source and entrained in air drawn through the smoking article.

Such smoking article typically comprises a plurality of segments, such as for example the heat source, the aerosol-forming substrate containing the tobacco, air directing elements, one or more filter segments, etc., which have to be combined and assembled to form the final smoking article. Accordingly, there is a need to provide for a method and apparatus for effectively and reliably combining segments of a smoking article.

According to one aspect of the invention there is provided a method for combining segments of a smoking article. The method comprises the step of providing a group of segments, the group of segments comprising a heat source and an aerosol-forming substrate which are coaxially arranged in that sequence, preferably along a common central longitudinal axis. The aerosol-forming substrate is arranged such that a remote end of the aerosol-forming substrate faces away from the heat source while a near end of the aerosol-forming substrate abuts the heat source.

The method further comprises the step of feeding an airflow directing truncated hollow cone having a widest end and a truncated narrowest end towards the group of segments in a manner such that the truncated narrowest end of the truncated hollow cone is arranged to face the remote end of the aerosol-forming substrate, with a central longitudinal axis of the truncated hollow cone preferably being aligned with the common central longitudinal axis of the group of segments. Still further, the method comprises the step of moving the truncated hollow cone towards the remote end of the aerosol-forming substrate to abut the remote end of the aerosol-forming substrate or to extend into an indentation in the remote end of the aerosol-forming substrate.

The provision of the group of segments and the feeding of the airflow directing hollow truncated cone is performed such that the truncated hollow cone can subsequently be moved towards the remote end of the aerosol-forming substrate. The hollow cone may be moved towards the remote end of the aerosol-forming substrate such that the narrowest end of the cone abuts the aerosol-forming substrate, or it may be positioned to extend into a hole or indentation which has been formed in the aerosol-forming substrate. Before moving the truncated hollow cone towards the remote end of the aerosol-forming substrate, the central longitudinal axis of the truncated hollow cone is preferably aligned with the common longitudinal axis of the group of segments such that movement of the truncated hollow cone towards the remote end of the aerosol-forming substrate can be performed by a linear movement of the truncated hollow cone and the group of segments relative to each other.

Generally, movement of the cone into a position in which it either abuts the remote end of the aerosol-forming substrate or in which it extends into an indentation in the remote end of the aerosol-forming substrate can be performed with or without an outer wrapper being wrapped around the group of segments.

As regards the movement of the cone towards the aerosol-forming substrate without an outer wrapper being wrapped around the group of segments, it is possible, by way of example, to move the narrowest end of the truncated hollow cone into an indentation in the remote end of the aerosol-forming substrate without an outer wrapper being wrapped around the group of segments. Only thereafter, an outer wrapper is wrapped around this arrangement of the group of segments and the inserted cone, this outer wrapper then forming an air-intake tube.

Alternatively, it is also possible to provide a separate individual air-intake tube and to arrange the separate individual air-intake tube (a separate segment) in abutting relationship to the remote end of the aerosol-forming substrate. The truncated hollow cone may then be inserted into the individual air-intake tube and moved towards the remote end of the aerosol-forming substrate such that the narrowest end of the truncated hollow cone either abuts the remote end of the aerosol-forming substrate or extends into an indentation in the remote end of the aerosol-forming substrate.

The movement of the truncated hollow cone towards the remote end of the aerosol-forming substrate can also be performed with an outer wrapper already being provided around the group of segments. The outer wrapper then extends beyond the remote end of the aerosol-forming substrate.

In this case, the outer wrapper itself may form an air-intake tube into which the truncated hollow cone is inserted and moved to either abut the remote end of the aerosol-forming substrate or to extend into an indentation in the remote end of the aerosol-forming substrate.

Alternatively, it is also possible that a separate individual air-intake tube is already provided in abutting relationship to the remote end of the aerosol-forming substrate, this air-intake tube being wrapped by the outer wrapper. The truncated hollow cone may then be inserted into the individual air-intake tube and moved towards the remote end of the aerosol-forming substrate such that the narrowest end of the truncated hollow cone either abuts the remote end of the aerosol-forming substrate or extends into an indentation in the remote end of the aerosol-forming substrate.

Although the cone generally may be moved towards the remote end of the aerosol-forming tube with or without an air-intake tube being present, in a preferred embodiment, the method according to the invention comprises the step of providing an air intake-tube around the truncated hollow cone. The air-intake tube has an inner diameter which essentially corresponds to the outer diameter of the truncated hollow cone. The term "essentially corresponds to the outer diameter of the truncated hollow cone" is to be understood in a sense, that the inner diameter of the air-intake tube is either slightly larger than the outer diameter of the truncated hollow cone (so that for example a small amount of glue, wax, silicone or combinations thereof can be applied to the outer surface of the cone at the widest end thereof to connect the widest end of cone to the air-intake tube in an air-tight manner), or that the outer diameter of the truncated hollow cone at the widest end thereof exactly corresponds to the inner diameter of the air-intake tube, or that the outer diameter of the truncated hollow cone at the widest end of the cone is slightly larger than the inner diameter of the air-intake tube. In the latter case, the truncated hollow cone may form an air-tight press-fit with the air-intake tube so that no gluing of the widest end of the truncated hollow cone to the air-intake tube is to be performed. The positioning of the truncated cone in the air-intake tube (either abutting the aerosol-forming substrate or extending into a hole or indentation of formed in the aerosol-forming substrate) is performed such that in a final smoking article, an airflow pathway extends between the at least one air inlet and the mouth end of the smoking article. The volume bounded radially by the exterior of the hollow truncated cone and the interior of the air-intake tube defines the first portion of the airflow pathway. Preferably, during use, air brought in through the air inlet moves longitudinally upstream from the at least one air inlet towards the aerosol-forming substrate. The volume bounded radially by the interior of the hollow truncated cone defines the second portion of the airflow pathway. During use, air and any volatile compounds entrained by the air after passing through the aerosol forming substrate, move longitudinally downstream through the second portion of the airflow pathway towards the mouth end of the smoking article. Aerosols and other substances generated from the aerosol-forming substrate pass from the aerosol-forming substrate through the narrowest end of the airflow directing truncated cone and further through the interior of the hollow truncated cone in the direction towards a user drawing at a downstream end of the smoking article. Aerosols or other substances are generated by heating the aerosol-forming substrate through the transfer of heat from the heat source. The truncated hollow cone with its internal volume increasing from the narrowest to the widest end of the cone functions as an expansion chamber. This allows the cooling of the aerosols generated in the aerosol-forming substrate.

As used herein, the term 'abut' means to be touching, to be lying adjacent or next to, or to be bordering upon.

As used herein, the terms 'upstream' and 'front', and 'downstream' and 'rear', are used to describe the relative positions of components, or portions of components, of the smoking article in relation to the direction in which a user draws on the smoking article during use thereof. Smoking articles according to the invention comprise a mouth end and an opposed distal end. In use, a user draws on the mouth end of the smoking article. The mouth end is downstream of the distal end. The heat source is located at or proximate to the distal end.

As used herein, the term 'air inlet' is used to describe one or more holes, slits, slots or other apertures in the outer wrapper and any other materials circumscribing components of smoking articles according to the invention downstream of the aerosol-forming substrate through which air may be drawn into the first portion of the airflow pathway.

The airflow directing truncated hollow cone is preferably formed from one or more substantially gas impermeable materials which are substantially stable at the temperature of the aerosol generated by the transfer of heat from the heat source to the aerosol-forming substrate. Suitable materials are known in the art and include, but are not limited to, cardboard, plastic, ceramic, and combinations thereof. The widest end of the truncated cone may have a diameter in the range of about 5 mm to about 9 mm, for example in the range of about 7 mm to about 8 mm (here and in the following, the term "about" being understood as explicitly including and disclosing the respective boundary value). Preferably, the widest end of the truncated hollow cone is of substantially the same outer diameter as the inner diameter of the air-intake tube, so that the truncated hollow cone—once inserted into the air-intake tube—is arranged to be substantially gas-tight within the air-intake tube to prevent air or aerosols from leaking through a space between the hollow cone and the air-intake tube. The substantially gas-tight arrangement of the cone within the air intake tube may be achieved by a press-fit of the cone, or the cone can be provided with a seal, such as glue, wax, silicone, and combinations thereof at the widest end. The narrowest end of the truncated cone may have a diameter in the range of about 2 mm to about 5 mm, for example in the range of about 2.5 mm and about 4.5 mm. However, the widest end and the narrowest end of the truncated cone may have other diameters depending upon the desired overall diameters of the smoking article. A length of the truncated cone may be in a range of about 7 mm to about 50 mm, for example in a range of about 10 mm to about 45 mm, and in particular in the range of about 15 mm to about 30 mm. However, the truncated hollow cone may have other lengths depending upon the desired overall length of the smoking article, and the presence and length of other components in the smoking article.

The heat source used in the present invention may be a combustible heat source, heat sink, a chemical heat source, an electrical heat source or a combination thereof. Preferably, the heat source is a combustible heat source, such as for example a carbonaceous or carbon-based heat source. As used herein, the term 'carbonaceous' is used to describe a combustible heat source comprising carbon, while the term 'carbon-based heat source' is used to describe a heat source comprised primarily of carbon. The combustible carbonaceous heat source preferably has a carbon content of at least about 35 percent, more preferably of at least about 40 percent, most preferably of at least about 45 percent by dry weight of the combustible heat source. Combustible carbon-based heat sources preferably have a carbon content of at least about 50 percent, more preferably of at least about 60 percent, most preferably of at least about 80 percent by dry weight of the combustible carbon-based heat source. A combustible heat source may contain one or more additives. Preferably, suitable additives include, but are not limited to, additives to promote consolidation of the combustible heat source, to promote ignition of the combustible heat source, to promote combustion of the combustible heat source, additives to promote decomposition of one or more gases produced by combustion of the combustible heat source, or combinations of such additives. The heat source preferably comprises an ignition aid.

The air-intake tube may be a hollow tube and may be formed of or contain the same or different material as the airflow directing truncated cone. The air-intake tube preferably has one or more air inlets, preferably in a side wall of the tube, for allowing air from outside of the air-intake tube to enter through the one or more air inlets into the air-intake tube. If the air-intake tube is provided with outer wrappings, preferably also these outer wrappings comprise air inlets to interact with the air inlets in the air-intake tube. When a user draws at a downstream end of a smoking article made according to the invention, for example at a mouthpiece, air is made to pass through the aerosol-forming substrate and leave the aerosol-forming substrate (now enriched with volatile compounds from the heated aerosol-forming substrate) through the truncated narrowest end of the cone in the direction of the mouthpiece.

The aerosol-forming substrate preferably comprises at least one aerosol-former and a material capable of emitting volatile compounds in response to heating. Suitable aerosol-formers are well known in the art. Preferred aerosol-formers for use in smoking articles manufactured according to the invention are polyhydric alcohols or mixtures thereof, such as glycerine. Preferably, the material capable of emitting volatile compounds in response to heating is a charge of a plant-based material, more preferably a homogenized plant-based material. For example, the aerosol-forming substrate may comprise one or more materials derived from plants including, but not limited to, tobacco; tea, for example green tea; peppermint; laurel; eucalyptus; basil; sage; verbena; and tarragon. The plant-based material may comprise additives including but not limited to flavourants, binders, humectants and mixtures thereof. Preferably, the aerosol-forming substrate essentially consists of tobacco material, most preferably homogenized tobacco material. Preferably, the aerosol-forming substrate has a length in the range of about 5 mm to about 20 mm, more preferably in the range of about 8 mm to about 12 mm.

According to one aspect of the method according to the invention, the air-intake tube either abuts the remote end of the aerosol-forming substrate (e.g. separate individual air-intake tube) or extends over the aerosol-forming substrate (e.g. wrapper forming the air-intake tube), and the step of moving the truncated hollow cone towards the remote end of the aerosol-forming substrate comprises pushing the truncated hollow cone through a remote end of the air-intake tube into a final position.

Pushing the airflow directing truncated hollow cone into the air-intake tube can be preferably done by means of a transfer tool. The transfer tool preferably pushes and guides the truncated hollow cone while inserting the cone into the air-intake tube. The transfer tool at least partly enters the truncated hollow cone through the widest end of the cone. With a portion of the transfer tool being arranged inside the truncated hollow cone, support and alignment of the truncated hollow cone may be provided. Preferably, the transfer tool or a portion of the transfer tool has a shape corresponding to the shape of the interior of the truncated hollow cone. The shape of the transfer tool may thereby support the truncated hollow cone while inserting the cone into the air-intake tube. Once the cone has been inserted into the air-intake tube and has reached its final position, the transfer tool can be retracted. The transfer tool may then be used for insertion of a subsequent truncated hollow cone into a subsequent air-intake tube.

The final position may be a position in which the truncated narrowest end of the truncated hollow cone abuts the remote end of the aerosol-forming substrate. Alternatively, the final position may be a position in which the truncated narrowest end of the truncated cone extends into the aerosol-forming substrate, preferably into an indentation formed in the remote end of the aerosol-forming substrate. By controlling the insertion depth of the truncated cone the location at which the aerosol exits the aerosol-forming substrate may be defined and controlled. Such control may advantageously facilitate producing smoking articles having desired aerosol delivery rates. In preferred embodiments, the truncated narrowest end of the truncated hollow cone extends into the aerosol-forming substrate to a distance up to about half the length of the aerosol-forming substrate. If the truncated hollow cone extends into the aerosol-forming substrate, an indentation for receiving the narrowest end of the cone is preferably formed in the aerosol forming substrate before inserting the narrowest end of the cone into the substrate. In an alternative embodiment, the indentation is formed concurrently as the narrowest end of the cone is inserted into the aerosol forming substrate.

According to a further aspect of the method according to the invention, the step of moving the truncated hollow cone towards the remote end of the aerosol-forming substrate comprises providing a transfer tool having a tip. The transfer tool is inserted into the truncated hollow cone to an extent that the tip of the transfer tool preferably projects from the truncated cone through the narrowest end of the truncated hollow cone. The transfer tool together with the truncated hollow cone is then moved towards the remote end of the aerosol-forming substrate. Preferably, the tip of the transfer tool forms an indentation in the aerosol-forming substrate and the narrowest end of the truncated hollow cone extends into the indentation formed in the aerosol-forming substrate.

The truncated hollow cone can be moved towards the remote end of the aerosol-forming substrate with or without an air-intake tube being present. Preferably, the step of forming an indentation is combined with the insertion of the truncated hollow cone into the air-intake tube. The tip of the transfer tool projecting from the narrowest end of the truncated cone and forming the indentation has a diameter which substantially corresponds to the diameter of the narrowest end of the truncated hollow cone. Once the transfer tool has been inserted through the widest end of the truncated hollow cone and further through the truncated cone, the transfer tool together with the cone is moved into the direction of the aerosol-forming substrate. The tip of the transfer tool is thereby allowed to form the indentation in the aerosol-forming substrate, followed by the truncated narrowest end of the cone. In case no air-intake tube is present, the tip of the transfer tool also forms the indentation in the aerosol-forming substrate, followed by the truncated narrowest end of the cone.

In alternative embodiments, the indentation may be preformed in the aerosol-forming substrate independently of the insertion process. Such indentation may for example be a hole or a circular or conical cut-out in the aerosol-forming substrate.

According to yet another aspect of the method according to the invention, the method preferably further comprises the step of attaching the airflow directing hollow cone to the air-intake tube in an tight manner such that air flow between the truncated hollow cone and the air intake-tube is at least substantially prevented at the widest end of the hollow tube.

The air-intake tube may be attached to the truncated cone when the cone is arranged in the final position inside the air-intake tube to secure the position of the cone in the air-intake tube and also relative to the other segments of the group of segments. Such an attachment may for example be achieved by a press-fit of the cone in the air-intake tube. This can be achieved with a cone having an outer diameter at the widest end of the cone which is the same or slightly larger than the inner diameter of the air-intake tube. An alternative or additional attachment may be achieved by gluing or by otherwise making the widest end of the truncated hollow cone stick or adhere to the air-intake tube, or by a combination of such attachments. By attaching the truncated hollow cone to the air-intake tube or by having a press-fit relationship with the air-intake tube, air leakage flow between the widest end of the cone and the air-intake tube preferably is substantially or completely prevented. In certain preferred embodiments, a seal around the downstream end of the truncated hollow cone completely prevents air from leaking through between the exterior of the widest end of the truncated hollow cone and the interior of the air-intake tube.

In alternative embodiments, some air may leak between the exterior of the widest end of the truncated hollow cone and the interior of the air-intake tube. In such alternative embodiments, the resistance-to-draw of air from proximate the air inlet through the air-intake tube immediately downstream of the widest end of the truncated hollow cone should be less than the resistance-to-draw of air from proximate the air inlet through the widest end of the truncated hollow cone and the interior of the air-intake tube.

The resistance to draw is measured in accordance with ISO 6565:2011 and is typically expressed in units of $mmH_2O$.

In the alternative embodiments where some air may leak between the exterior of the widest end of the truncated hollow cone and the interior of the air-intake tube, the resistance-to-draw of air from proximate the air inlet through the air-intake tube downstream of the widest end of the truncated hollow cone may be measured by transversely cutting the air-intake tube downstream of the widest end of the truncated hollow cone, and drawing on the cut downstream end of the air-intake tube.

Similarly, the resistance-to-draw of air in the first portion of the airflow pathway from proximate the air inlet through the widest end of the truncated hollow cone and the interior of the air-intake tube may then be measured by sealing the truncated narrowest end of the truncated hollow cone such that air can flow only through the gap between the exterior of the hollow truncated cone and the interior of the air-intake tube, and drawing on the downstream end of the air-intake tube.

In certain preferred embodiments, the ratio of the resistance-to-draw of air from proximate the air inlet through the air-intake tube downstream of the widest end of the truncated hollow cone to the resistance-to-draw of air in the first portion of the airflow pathway from proximate the air inlet through the widest end of the truncated hollow cone and the interior of the air-intake tube is between about 1:3 to about 1:5. For example, in such preferred embodiments, the resistance-to-draw of air from proximate the air inlet through the air-intake tube downstream of the widest end of the truncated hollow cone is preferably between about 50 $mmH_2O$ to about 100 $mmH_2O$, while the corresponding resistance-to-draw of air in the first portion of the airflow pathway from proximate the air inlet through the widest end of the truncated hollow cone and the interior of the air-intake tube may preferably be between about 150 $mmH_2O$ to about 500 $mmH_2O$.

In accordance with a further aspect of the method according to the invention, the step of feeding an airflow directing truncated hollow cone towards the group of segments comprises feeding a continuous strand of truncated hollow cones, with adjacent truncated hollow cones of the strand being connected to each other, towards the group of segments. The foremost truncated hollow cone is then separated from the strand. According to a further aspect of the method according to the invention, the group of segments is provided as a jointly wrapped component. The jointly wrapped component comprises a wrapper extending beyond the end of the aerosol-forming substrate remote from the heat source. The truncated hollow cone is inserted into at least the air-intake tube through the remote end of the air-intake tube of the jointly wrapped component. In this embodiment, the individual segments of the group of segments are held in a fixed position relative to each other by the wrapper. The wrapper may for example be a short strip of paper or a plastic or metal foil. By way of example only, the wrapper does not only extend over at least part of the heat source and the aerosol-forming substrate (or additional segments, if applicable) but also extends beyond the remote end of the aerosol-forming substrate. The wrapper extending beyond the remote end of the aerosol-forming may form the air-intake tube. In this case, the wrapper not only holds the heat source and the aerosol-forming substrate in position, but also forms a segment (the air-intake tube) itself. This segment has the shape of a hollow tube. The air-intake tube as a segment of a jointly wrapped component may be formed in this way. Alternatively, the air-intake tube is a separate individual wrapped by that portion of the wrapper extending beyond the aerosol-forming substrate. In this case, the portion of the wrapper extending beyond the aerosol-forming substrate does not form the air-intake tube, since one of the wrapped individual segments is the air intake-tube.

If jointly wrapped components are used in the method according to the invention, the method may further comprise the step of transferring the jointly wrapped component comprising the group of segments together with the inserted truncated hollow cone inserted into the air-intake tube to an assembler for assembly of the jointly wrapped component with additional components or segments of a smoking article. Preferably, further components or segments of smoking articles are for example an expansion chamber or a mouthpiece. These further components or segments are arranged downstream of the airflow directing truncated hollow cone. For example, a mouthpiece may be a single segment mouthpiece or a multi-segment mouthpiece. A mouthpiece may comprise a filter made of cellulose acetate, paper or other suitable known filter materials. In addition, a mouthpiece may also comprise adsorbents, flavourants, or other aerosol modifiers and additives.

According to another aspect of the method according to the invention, the air-intake tube is an individual segment which is not connected to the other segments of the group, and wherein the truncated hollow cone is inserted into the air-intake tube through the remote end of the air-intake tube while the air-intake tube is not connected to the other segments of the group. In particular, the air-intake tube is neither connected to the heat source nor to the aerosol-forming substrate before the truncated cone is inserted into the air-intake tube. According to this aspect of the method, the method preferably further comprises the step of transferring the group of segments with the airflow directing truncated hollow cone being inserted into the air-intake tube to a wrapping garniture for wrapping the group of segments provided with the airflow directing cone with a web of material. After such wrapping, the now wrapped group of segments may then further be transferred to an assembler for assembly with further segments or components of a smoking article as described above with respect to the jointly wrapped component.

As mentioned, in this embodiment the air-intake tube is provided as an individual segment which is aligned with but not connected to the other segments of the group of segments. The transfer tool inserting the truncated hollow cone into the air-intake tube may then also serve to secure the position of the air-intake tube next to and preferably abutting the adjacent aerosol-forming substrate. After the truncated hollow cone has been inserted at least into the air-intake tube, the group of segments is then preferably transferred to the wrapping garniture to be wrapped. The wrapper applied by the wrapping garniture then holds the segments in fixed positions relative to each other.

In another aspect of the method according to the invention, the method further comprises the step of arranging the common central longitudinal axis of the group of segments to extend perpendicular to a direction of transport of the group of segments, prior to aligning the central longitudinal axis of the truncated hollow cone to be moved towards the remote end of the aerosol-forming substrate with the common central longitudinal axis of the group of segments. Once the axes are aligned, movement of the cone towards the aerosol-forming substrate can be performed by a simple linear movement of the cone (for example with the aid of the transfer tool) along the aligned longitudinal axes.

In the production of smoking articles, a plurality of groups of segments are preferably arranged such that the common central longitudinal axes of the groups of segments are arranged parallel to each other. For example, the groups of segments may be arranged parallel and next to each other on a linear conveyor while being transported perpendicular to the orientation of their longitudinal axes by means of the conveyor. A method to achieve a parallel arrangement which is especially suitable for high-speed manufacturing processes of smoking articles is to arrange and hold the groups of segments on an outer circumference of a rotatable drum, for example in corresponding flutes arranged parallel to each other. Thereby, the common central longitudinal axes of the groups of segments provided in the flutes are arranged parallel to a longitudinal or rotational axis of the rotatable drum. The direction of rotation of the drum corresponds to the direction of transport of the groups of segments. The groups of segments are preferably arranged such that all groups face in a same direction. The remote ends of the respective aerosol-forming substances face in a direction away from the respective heat sources to receive the airflow directing truncated cones. By way of example, the groups of segments may be held in the flutes by means of suction.

According to another aspect of the invention, there is provided a combiner for combining segments of smoking articles. The combiner comprises a plurality of flutes arranged in parallel, each flute being adapted to receive and transport a group of segments comprising a heat source and an aerosol-forming substrate coaxially arranged in that sequence along a common central longitudinal axis. The aerosol-forming substrate is arranged such that a remote end of the aerosol-forming substrate faces away from the heat source while a near end of the aerosol-forming substrate abuts or extends over the heat source. The combiner further comprises a feeder arranged to feed a respective individual airflow directing truncated hollow cone having a widest end and a truncated narrowest end towards the respective flute. The feeder is adapted to feed the respective truncated hollow cone in a manner such that the truncated narrowest end of the respective truncated hollow cone is arranged to face the remote end of the respective aerosol-forming substrate. A central longitudinal axis of the truncated hollow cone and the common central longitudinal axis of the respective group of segments in the respective flute are aligned with each other. The combiner further comprises a transfer tool which is arranged to be movable in the direction of the common central longitudinal axis of the group of segments in the respective flute towards and away from the remote end of the respective aerosol-forming substrate in the respective flute. The transfer tool is adapted to push the respective truncated hollow cone through towards the remote end of the respective aerosol-forming substrate to abut the remote end of the respective aerosol-forming substrate or to extend into an indentation in the remote end of the respective aerosol-forming substrate.

In some preferred embodiments of the combiner according to the invention, the transfer tool comprises an abutment flange at a proximal end of the transfer tool for abutting the widest end of the respective truncated hollow cone for pushing the respective truncated hollow cone during movement of the transfer tool towards the respective aerosol-forming substrate. The transfer tool further comprises a cone-shaped support portion for supporting the truncated hollow cone during movement of the transfer tool towards the respective aerosol-forming substrate.

The cone-shaped support portion is inserted into the truncated hollow cone through the widest end of the truncated hollow cone and may support a pushing action as well as a centering of the truncated cone. The abutment flange may serve to uniformly distribute the pushing force acting on the widest end of the truncated hollow cone during movement of the truncated hollow cone towards the respective aerosol-forming substrate.

The transfer tool may further be provided with a tip for forming an indentation in an aerosol-forming substrate, as described above. Preferably, the transfer tool is provided with a tip if the truncated hollow cone is to be inserted into the aerosol-forming substrate to at least partly extend into the aerosol-forming substrate and if formation of an indentation in the aerosol-forming substrate is to be performed together with insertion of the truncated hollow cone.

According to a further aspect of the invention, the plurality of flutes is arranged on the outer surface of a rotatable drum. An individual transfer tool is arranged in each of the flutes arranged on the outer surface of the rotatable drum. And although linear conveyors are generally also possible for transportation of the groups of segments, a rotatable drum having flutes thereon is particularly advantageous in the manufacturing of smoking articles since it allows for reliable manufacturing at high speed.

The advantages of the aspects of the combiner have already been discussed in combination with the aspects of the method and will therefore not be repeated here. Preferably, the method and combiner according to the invention and as described above are used in the manufacture of smoking articles, especially of smoking articles where tobacco is heated rather than combusted as in conventional cigarettes.

The afore-mentioned embodiments of the method and combiner according to the invention will become more apparent with the aid of the following detailed description of embodiments of the invention in which.

Figure 1:
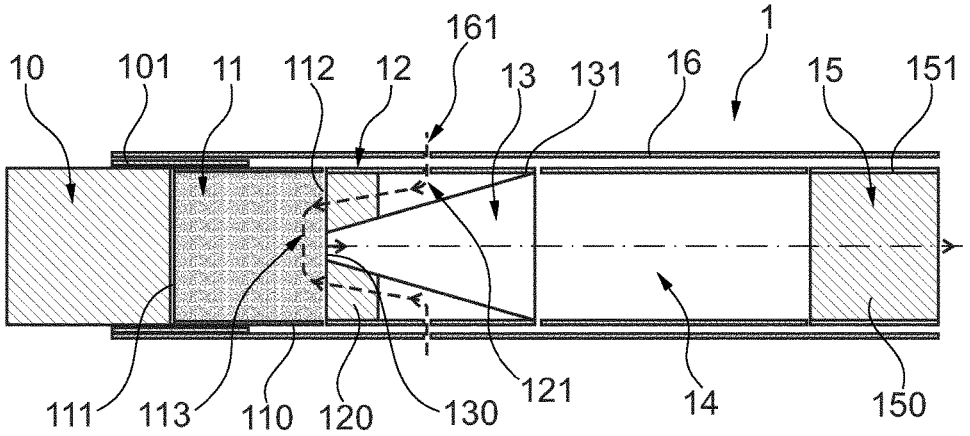
FIG. 1 shows a longitudinal cross-section of a first embodiment of a heated smoking article comprising a truncated hollow cone and a separate air-intake tube.

The first embodiment of a heated smoking article 1 shown in FIG. 1 comprises a combustible carbonaceous heat source 10 and an aerosol-forming substrate 11. Aerosol-forming substrate 11 is located immediately downstream of the combustible carbonaceous heat source and is circumscribed by filter plug wrap 110. A near end 111 of the aerosol-forming substrate 11 is arranged abutting the carbonaceous heat source 10. A heat-conducting element 101 consisting of a tubular layer of aluminum foil surrounds and longitudinally extends partially over carbonaceous heat source 10 and aerosol-forming substrate 11 which may comprise a plug of glycerine and tobacco material. Further downstream of the aerosol-forming substrate 11, a separate individual hollow air-intake tube 12 is arranged in abutting relationship to a remote end 112 of the aerosol-forming substrate 11. Within air-intake tube 12 an air-directing truncated hollow cone 13 is arranged in a manner such that a truncated narrowest end 130 of the cone 13 abuts the remote end 112 of the aerosol-forming substrate 11. The truncated narrowest end 130 of cone is supported in an air-permeable diffuser 120 arranged within the air-intake tube 12 in abutting relationship to the remote end 112 of the aerosol-forming substrate 11. The widest end 131 of truncated hollow cone is air-tightly arranged in the air-intake tube 13, so that no air may leak between the widest end 131 of the cone 13 and the interior wall of air-intake tube 12. Downstream of the air-intake tube 12 there are arranged a tubular hollow expansion chamber 14 and a mouthpiece 15 comprising a filter plug 150 and a filter plug wrap 151. The entire arrangement of segments is overwrapped by an outer wrapper 16. Air inlets 161 are provided in the outer wrapper 16, and additional air-inlets 121 are provided in the air-intake tube 12.

In use, when a user draws on the mouthpiece of the smoking article 1, cool air is drawn in into the smoking article 1 through the air-inlets 161, 121. The drawn air passes between an outer wall of the truncated hollow cone 13 and an inner wall of the air-intake tube 12 along a first portion of the airflow pathway upstream to the aerosol-forming substrate 11. The aerosol-forming substrate 11 is heated by conduction of heat from the combustible heat source 10 via the heat-conducting element 101. The heating of the aerosol-forming substrate 11 releases volatile and semi-volatile components and glycerine from the plug of tobacco material, which form an aerosol that is entrained in the drawn air as it flows along a second portion of the airflow pathway through the interior of the cone 13 into the interior of expansion chamber 14 where they cool and condense. The cooled aerosol then passes downstream through the mouthpiece 15 of the smoking article.

Figure 2:
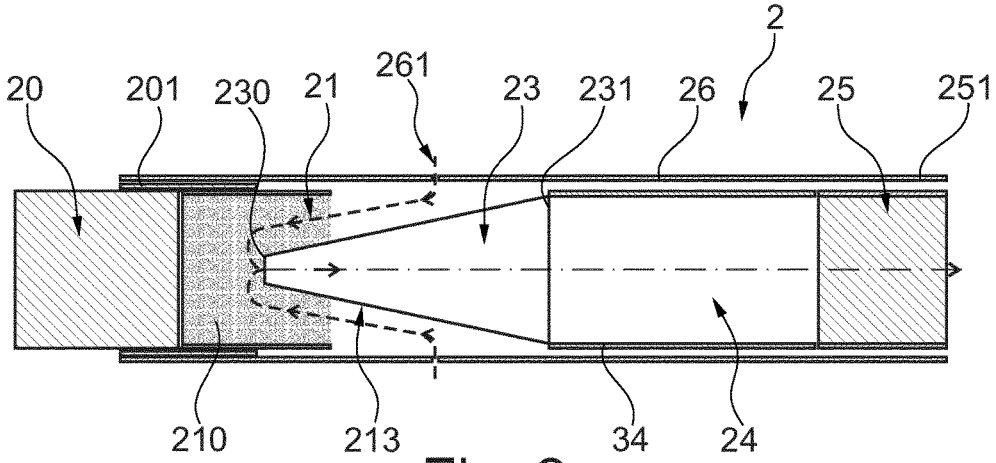
FIG. 2 shows a longitudinal cross-section of a second embodiment of a heated smoking article comprising a truncated hollow cone with no separate air-intake tube.

The embodiment of the smoking article 2 shown in FIG. 2 is to some extent similar to the embodiment shown in FIG. 1, so that the corresponding segments/parts are not explained in detail again. Downstream of the heat source 20 there is arranged the aerosol-forming substrate 21 circumscribed by filter plug wrap 210, with the near end 211 of the aerosol-forming substrate abutting the heat source 20. Similarly, a heat conducting element 201 is provided surrounding and partially extending over both the heat source 20 and the aerosol-forming substrate 21. Different from the embodiment shown in FIG. 1, however, the embodiment shown in FIG. 2 does not comprise a separate air-intake tube. Instead, in the remote end 212 of the aerosol-forming substrate 21 there is provided an indentation 213, into which the narrowest end 230 of the truncated hollow cone 23 extends. The front end of the wall of the tubular expansion chamber 24 abuts the widest end of cone 23 so that cone 23 is securely held in position. Further downstream of expansion chamber there is again arranged a mouthpiece 25 comprising a filter plug 250 and a plug wrap 251. The entire arrangement of segments is overwrapped by an outer wrapper 26, having air inlets 261. The mode of operation is very similar to the embodiment of FIG. 1 except that the air does not have to pass through air inlets of a separate air-intake tube since there is simply no such separate air-intake tube segment in the embodiment of FIG. 2.

Figure 3:
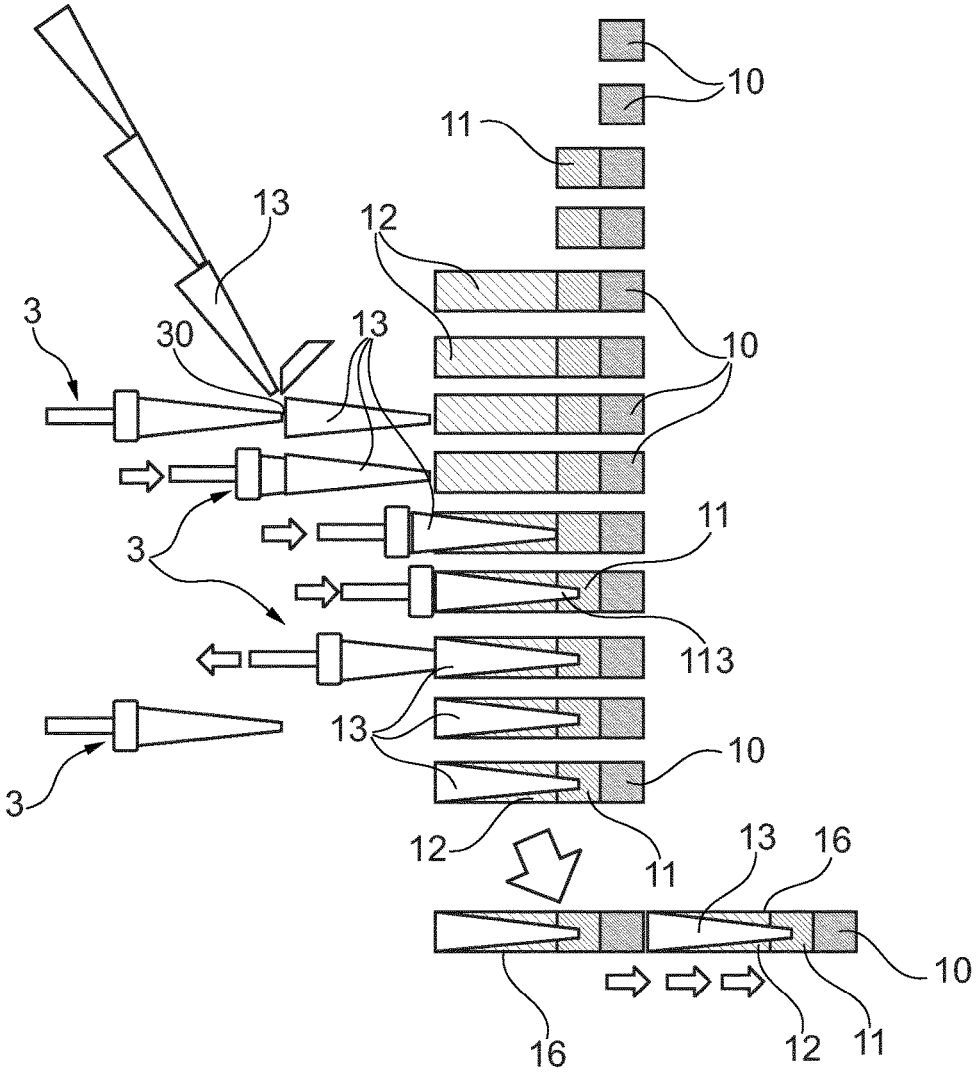
FIG. 3 shows a first embodiment of the method for combining segments of a smoking article according to the invention, with cone insertion being performed before wrapping.

FIG. 3 shows a first embodiment of the method for combining segments of a smoking article. In this first embodiment the cone is inserted before wrapping. Also, in the embodiment of FIG. 1 a separate air-intake tube is provided, however, this embodiment is also conceivable without such separate air-intake tube being provided. A heat source 10 and an aerosol-forming substrate 11 are fed and arranged in a manner such that the heat source 10 and the aerosol-forming substrate 11 are arranged along a common central longitudinal axis. The near end 111 of the aerosol-forming substrate 11 abuts the heat source 10. Thereafter, the separate tubular segment forming the separate air-intake tube 12 is fed and arranged in a manner such that the common central longitudinal axis of the group of segments and the central longitudinal axis of the air-intake tube 12 coincide. As a next step, a strand of truncated hollow cones 13 is fed and the foremost cone is cut from the strand. A transfer tool 3 having a tip 30 is then inserted into the cut truncated hollow cone 13, preferably to an extent that the tip 30 projects from the truncated hollow cone 13 through the narrowest end of the truncated hollow cone 13. The transfer tool 3 together with the cone 13 is then moved through a remote end of the air-intake tube 12 towards the remote end 112 of the aerosol-forming substrate 11 until the tip 30 of the transfer tool 3 forms an indentation 113 in the remote end of the aerosol-forming substrate 11, followed by the narrowest end of the truncated hollow cone 13. In an alternative embodiment, the tip 30 of the transfer tool 3 projects up to but not beyond the narrowest end of the truncated hollow cone 13. The transfer tool 3 together with the cone 13 is then moved through a remote end of the air-intake tube 12 towards the remote end 112 of the aerosol-forming substrate 11 until the narrowest end of the truncated hollow cone 13 has been inserted into the remote end 112 of the aerosol-forming substrate 11. The tip 30 of the transfer tool 3 provides support to the narrowest end of the truncated hollow cone 13 as it forms an indentation 113 in the remote end of the aerosol-forming substrate 11. Following insertion of the truncated hollow cone 13, the transfer tool 3 is then retracted so that the narrowest end of the truncated hollow cone 13 is arranged in the indentation 113 while the widest end of the cone 13 is in air-tightly arranged in the air-intake tube (as discussed above, this can be achieved by a press-fit or with the aid of glue, etc.). The segments so combined are then transferred for either getting wrapped or for being combined with additional segments and then getting wrapped.

Figure 4:
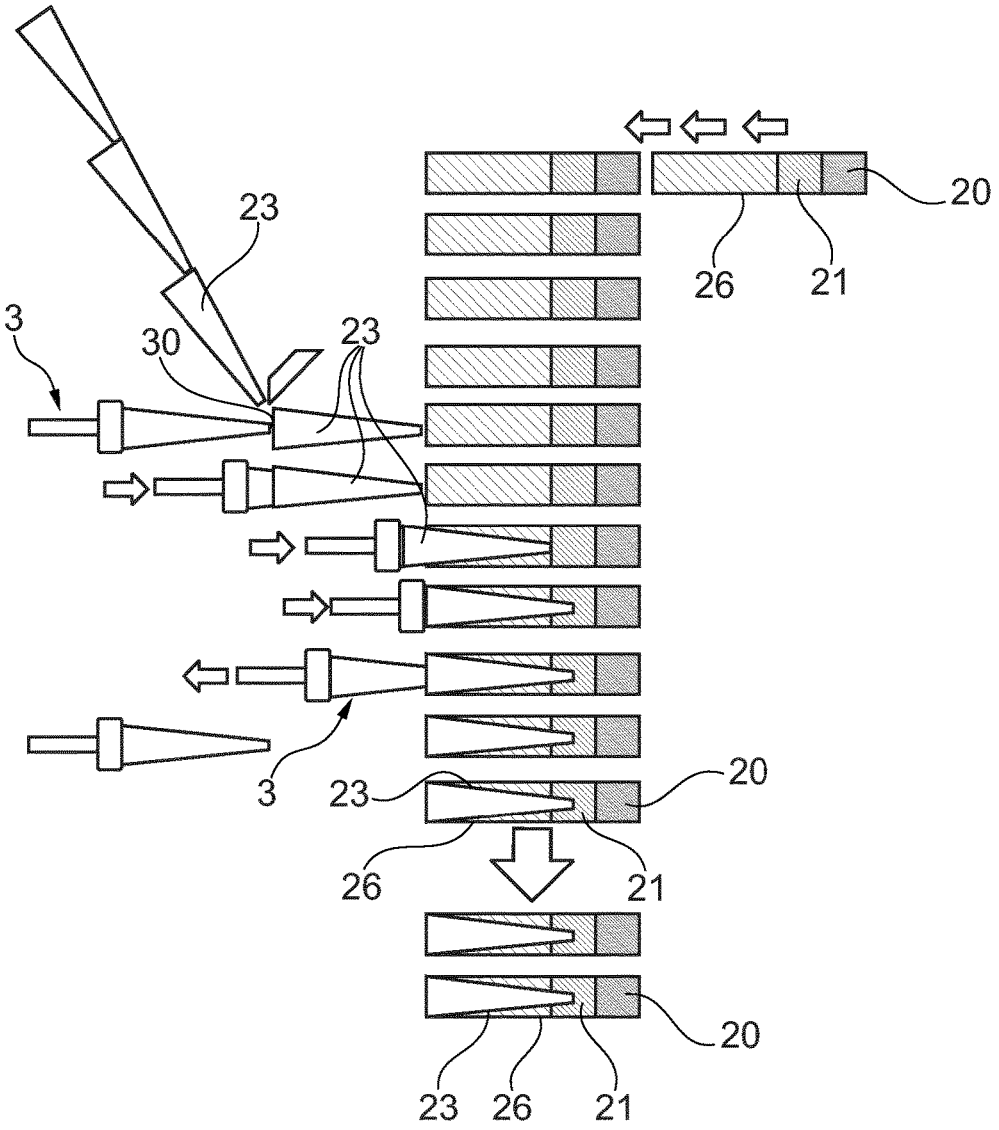
FIG. 4 shows a second embodiment of the method for combining segments of a smoking article according to the invention, with cone insertion being performed after wrapping.

FIG. 4 shows a second embodiment of the method for combining segments of a smoking article. In contrast to the first embodiment shown in FIG. 3, in the second embodiment shown in FIG. 4 the cone is inserted only after wrapping. Also, in the embodiment of FIG. 4 a separate air-intake tube is not provided, however, this embodiment is also conceivable with a separate air-intake tube being provided and also being wrapped before the cone is inserted. A heat source 20 and an aerosol-forming substrate 21 are fed and arranged in a manner such that the heat source 20 and the aerosol-forming substrate 21 are arranged along a common central longitudinal axis. The near end 211 of the aerosol-forming substrate 21 abuts the heat source 20. The heat source 20 and the aerosol-forming substrate 21 are wrapped by an outer wrapper 26 which longitudinally extends beyond the remote end 212 of the aerosol-forming substrate 21 in downstream direction. As a next step, a strand of truncated hollow cones 23 is fed and the foremost cone is cut from the strand. The transfer tool 3 having a tip 30 is then inserted into the cut truncated hollow cone 23 to an extent that the tip 30 projects from the truncated hollow cone 23 through the narrowest end of the truncated hollow cone 23. The transfer tool 3 together with the cone 23 is then moved through a remote end of the outer wrapper 26 towards the remote end 212 of the aerosol-forming substrate 21 until the tip 30 of the transfer tool 3 forms an indentation 213 in the remote end of the aerosol-forming substrate 21, followed by the narrowest end of the truncated hollow cone 23. In an alternative embodiment, the tip 30 of the transfer tool 3 projects up to but not beyond the narrowest end of the truncated hollow cone 23. The transfer tool 3 together with the cone 23 is then moved through a remote end of the outer wrapper 26 towards the remote end 212 of the aerosol-forming substrate 21 until the narrowest end of the truncated hollow cone 23 has been inserted into the remote end 212 of the aerosol-forming substrate 21. The tip 30 of the transfer tool 3 provides support to the narrowest end of the truncated hollow cone 23 as it forms an indentation 213 in the remote end of the aerosol-forming substrate 21. Following insertion of the truncated hollow cone 23, the transfer tool 3 is then retracted so that the narrowest end of the truncated hollow cone 23 is arranged in the indentation 213 while the widest end of the cone 23 is in air-tightly arranged in the air-intake tube (as discussed above, this can be achieved by a press-fit or with the aid of glue, etc.). The segments so combined are then transferred for getting assembled with additional segments to finally form the smoking article 2 (FIG. 2).

Figure 5:
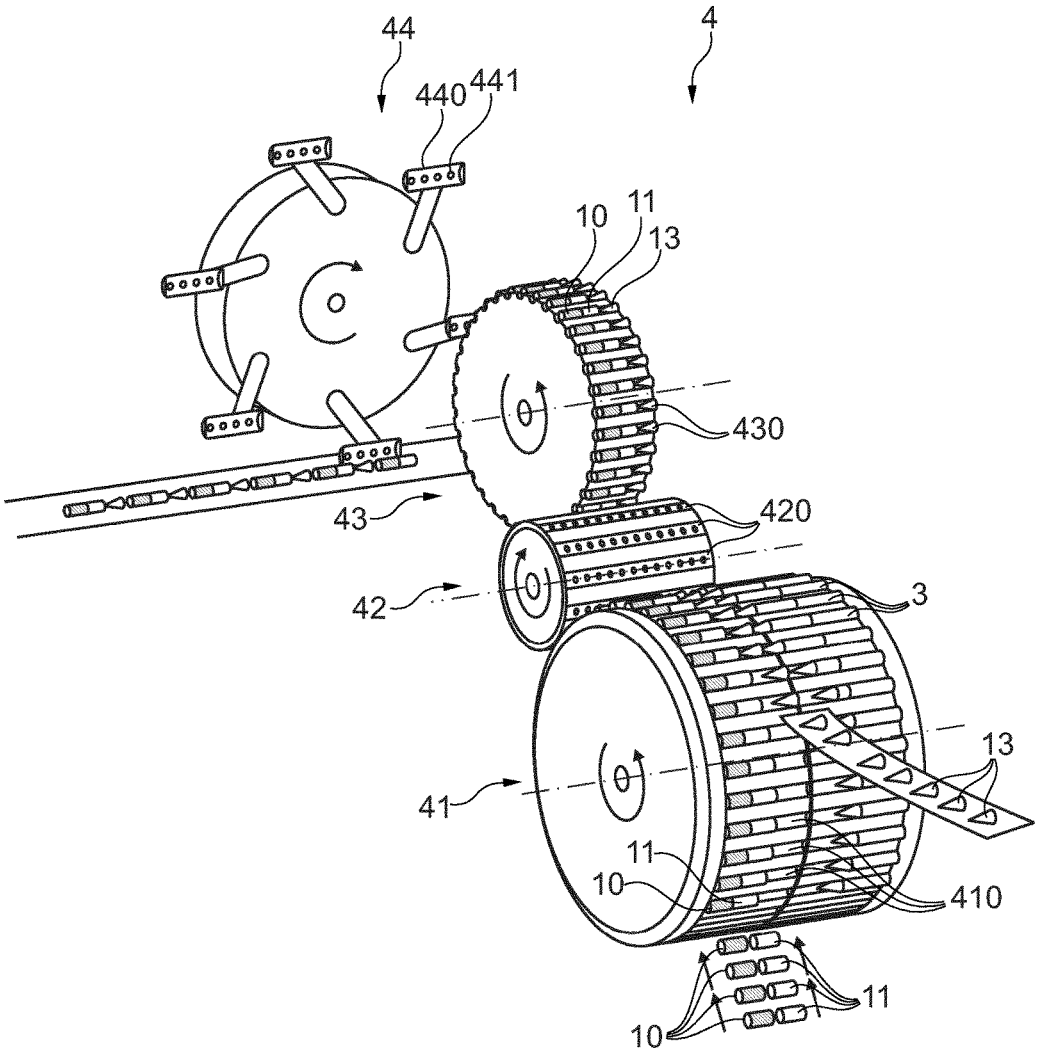
FIG. 5 shows a first embodiment of a combiner for combining segments of a smoking article according to the invention, with cone insertion being performed before wrapping.

FIG. 5 shows a first embodiment of a combiner 4 for combining segments of a smoking article according to the invention which operates in accordance with the first embodiment of the method according to the invention (see FIG. 3). As can be seen in FIG. 5, combiner 4 comprises three drums 41, 42 and 43 which are arranged with their rotational axes being parallel to each other. The drums 41, 42, 43 each comprise a plurality of flutes 410, 420, 430, respectively, which are arranged on the outer surface of the respective drum 41, 42, 43. Heat sources 10 and aerosol-forming substrates 11 are fed towards the flutes 410 of drum 41, such that a heat source 10 and an aerosol-forming substrate 11 are arranged in abutting relationship such that the near end 111 of the aerosol-forming substrate 11 abuts the heat source 10. The heat source 10 and the aerosol-forming substrate 11 may be held in the respective flute 410 with the aid of suction applied through the interior of the drum and through holes provided in the respective flutes 410. In addition, cones 13 are fed for example in the form of a strand towards the respective flutes 410 of the first drum 41. The foremost cone 13 is then cut from the strand and inserted into a flute 410, however, axially spaced apart from the arrangement of the heat source 10 and aerosol-forming substrate 11. The narrowest end of cone 13 is arranged to face the remote end 112 of the aerosol-forming substrate. In addition, as is shown in FIG. 5, in each flute a separate transfer tool 3 is arranged such that the respective transfer tool 3 can be inserted into the respective cone 13 through the widest end respective cone 13. During rotation of the drum 41, the respective transfer tool 3 is moved towards the remote end 112 of the aerosol forming substrate such that the tip 30 of the transfer tool 3 forms an indentation 113 in the remote end 112 of the aerosol-forming substrate 11, followed by the respective cone, or alternatively the tip 30 of the transfer tool 3 provides support to the narrowest end of the truncated hollow cone 13 as it forms an indentation 113 in the remote end of the aerosol-forming substrate 11, as explained in detail above (see uppermost flute 410 of the drum 41). The transfer tool is then retracted again leaving the narrowest end of the cone 13 inserted in the indentation 113. While the description above has not mentioned the presence of a separate air-intake tube 12 (FIG. 1), it is to be mentioned that in a preferred embodiment of the combiner a separate air-intake tube 12 may also be fed into each individual flute 410 in a manner such that it abuts the remote end 112 of the aerosol-forming substrate 11. The cone 13 is then fed through the remote end of the respective separate air-intake tube 12, as has been described above without the separate air-intake tube 12.

Once the cones 13 have been inserted either directly into the indentation 113 in the remote end of the aerosol-forming substrate 11 (either with or without the separate air-intake tube 12), the arrangement of segments is then transferred from the first drum 41 to a second drum 42 and subsequently to a third drum 43. Drums 42, 43 comprise corresponding flutes 420, 430 in which the arrangement of segments can be held in a manner similar to the manner described above (i.e. by means of suction). The individual arrangements of segments may then be transferred from the third drum 43 with the aid of a transfer wheel 44 comprising gripper elements 440 having suction openings 441 for gripping and transferring the individual arrangements of segments from the third drum to a linear wrapping system (for example a garniture tongue system known in the art).

Figure 6:
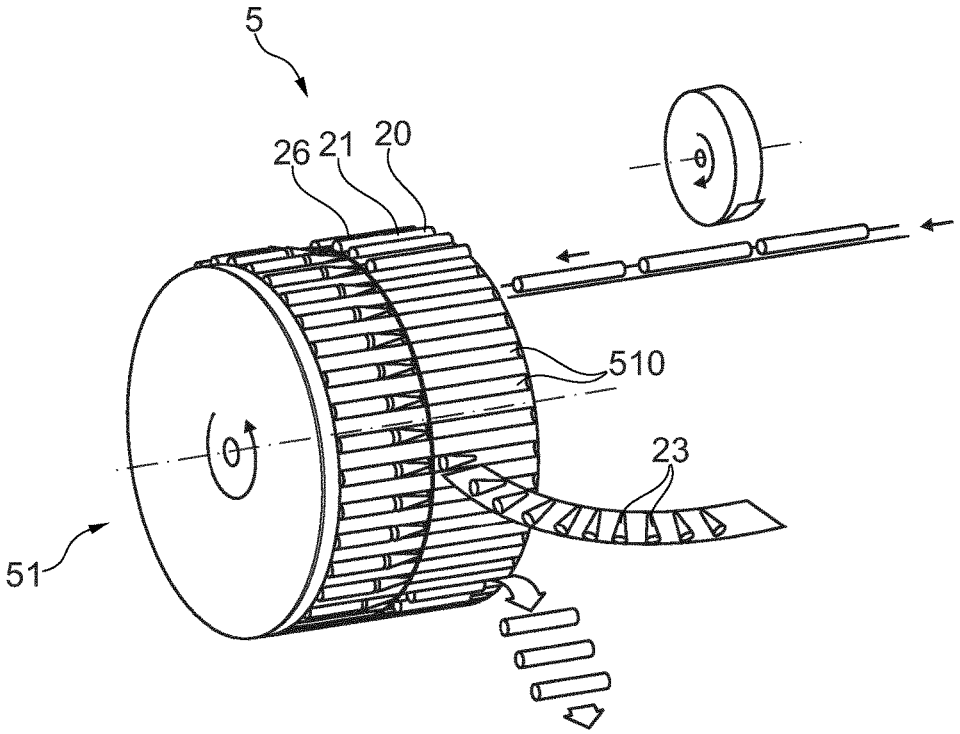
FIG. 6 shows a second embodiment of a combiner for combining segments of a smoking article according to the invention with cone insertion being performed after wrapping.

A second embodiment of a combiner 5 according to the invention is shown in FIG. 6 for combining segments of a smoking article according to the invention which operates in accordance with the second embodiment of the method according to the invention (see FIG. 4). The heat source 20 and aerosol-forming substrate 21 are already wrapped by an outer wrapper 26 which extends axially beyond the remote end 212 of the aerosol-forming substrate 21 (either with or without a separate air-intake tube 22 being wrapped by the outer wrapper 26). A plurality of such wrapped arrangements of heat source 20 and aerosol-forming substrate 21 (and eventually the separate air-intake tube 22) is then fed into respective flutes 510 arranged on the outer surface of a drum 51. Also, a strand of cones 23 is fed towards drum 51 and the foremost cone 23 of the strand is separated from the strand and inserted into a respective flute 510 on the outer surface of the drum spaced at an axial distance from the remote end of the outer wrapper 26. In each flute again, a transfer tool 3 is arranged such that the tip 30 of the respective transfer tool 3 can be inserted through the widest end of the respective cone 23, or alternatively the tip 30 of the transfer tool 3 projects up to but not beyond the narrowest end of the truncated hollow cone 23. The cone is then moved through the remote end of the outer wrapper 26 towards the remote end 212 of the aerosol-forming substrate, as this has already been explained above in connection with FIG. 5. Once the cone 23 has been moved to the final position, the transfer tool 3 is retracted again. Thereafter, the so formed arrangement of segment is transferred to an assembler to form the final smoking article.

While embodiments of the invention have been described with the aid of the drawings, the invention is not limited to these embodiments. Various changes and modifications are conceivable without departing from the teaching of the present invention. Therefore, the scope of protection is defined by the appended claims.

The invention claimed is:

1. Method for combining segments of a smoking article, the method comprising the steps of:

providing a group of segments, the group of segments comprising a heat source and an aerosol-forming substrate which are coaxially arranged in that sequence along a common central longitudinal axis, the aerosol-forming substrate being arranged such that a remote end of the aerosol-forming substrate faces away from the heat source while a near end of the aerosol-forming substrate abuts the heat source, feeding an airflow directing truncated hollow cone having a widest end and a truncated narrowest end towards the group of segments in a manner such that the truncated narrowest end of the truncated hollow cone is arranged to face the remote end of the aerosol-forming substrate, with a central longitudinal axis of the truncated hollow cone being aligned with the common central longitudinal axis of the group of segments, and moving the truncated hollow cone towards the remote end of the aerosol-forming substrate to abut the remote end of the aerosol-forming substrate or to extend into an indentation in the remote end of the aerosol-forming substrate.

2. Method according to claim 1, further comprising the step of providing an air-intake tube around the truncated hollow cone, the air-intake tube having an inner diameter which essentially corresponds to an outer diameter of the widest end of the truncated hollow cone.

3. Method according to claim 2, wherein the air-intake tube either abuts the remote end of the aerosol-forming substrate or extends over the aerosol-forming substrate, and wherein the step of moving the truncated hollow cone towards the remote end of the aerosol-forming substrate comprises pushing the truncated hollow cone through a remote end of the air-intake tube towards the remote end of the aerosol-forming substrate into a final position.

4. Method according to claim 3, wherein in the final position the truncated narrowest end of the truncated hollow cone abuts the remote end of the aerosol-forming substrate.

5. Method according to claim 3, wherein in the final position the truncated narrowest end of the truncated hollow cone extends into an indentation formed in the remote end of the aerosol-forming substrate.

6. Method according to claim 1, wherein the step of moving the truncated hollow cone towards the remote end of the aerosol-forming substrate comprises providing a transfer tool having a tip, inserting the transfer tool into the truncated hollow cone to an extent that the tip of the transfer tool projects from the truncated hollow cone through the narrowest end of the truncated hollow cone, and moving the transfer tool together with the truncated hollow cone towards the remote end of the aerosol-forming substrate until the tip of the transfer tool forms the indentation in the aerosol-forming substrate and the narrowest end of the truncated hollow cone extends into the indentation formed in the aerosol-forming substrate.

7. Method according to claim 2, further comprising the step of attaching the truncated hollow cone to the air-intake tube in an air-tight manner such that an air flow between the truncated hollow cone and the air-intake tube is prevented.

8. Method according to claim 1, wherein the step of feeding an airflow directing truncated hollow cone towards the group of segments comprises feeding a continuous strand of truncated hollow cones, with adjacent truncated hollow cones of the strand being connected to each other, towards the group of segments and separating the foremost truncated hollow cone from the continuous strand of truncated hollow cones.

9. Method according to claim 2, wherein the group of segments is provided as a jointly wrapped component, the jointly wrapped component comprising a wrapper extending beyond the remote end of the aerosol-forming substrate, wherein either the wrapper extending beyond the remote end of the aerosol-forming substrate forms the air-intake tube or the air-intake tube is a separate individual segment wrapped by that portion of the wrapper extending beyond the remote end of the aerosol-forming substrate, and wherein the truncated hollow cone is inserted into the air-intake tube through the remote end of the air-intake tube.

10. Method according to claim 9, further comprising the step of transferring the jointly wrapped component comprising the group of segments together with the truncated hollow cone inserted into the air-intake tube to an assembler for assembly of the jointly wrapped component with additional components of a smoking article.

11. Method according to claim 2, wherein the air-intake tube is an individual segment which is not connected to the other segments of the group, and wherein the truncated hollow cone is inserted into the air-intake tube through the remote end of the air-intake tube while the air-intake tube is not connected to the other segments of the group.

12. Method according to claim 1, further comprising the step of arranging the common central longitudinal axis of the group of segments to extend perpendicular to a direction of transport of the group of segments, prior to aligning the central longitudinal axis of the truncated hollow cone to be moved towards the remote end of the aerosol-forming substrate with the common central longitudinal axis of the group of segments.

13. Method according to claim 2, wherein the step of moving the truncated hollow cone towards the remote end of the aerosol-forming substrate comprises providing a transfer tool having a tip, inserting the transfer tool into the truncated hollow cone to an extent that the tip of the transfer tool projects from the truncated hollow cone through the narrowest end of the truncated hollow cone, and moving the transfer tool together with the truncated hollow cone towards the remote end of the aerosol-forming substrate until the tip of the transfer tool forms the indentation in the aerosol-forming substrate and the narrowest end of the truncated hollow cone extends into the indentation formed in the aerosol-forming substrate.

14. Method according to claim 4, wherein the step of moving the truncated hollow cone towards the remote end of the aerosol-forming substrate comprises providing a transfer tool having a tip, inserting the transfer tool into the truncated hollow cone to an extent that the tip of the transfer tool projects from the truncated hollow cone through the narrowest end of the truncated hollow cone, and moving the transfer tool together with the truncated hollow cone towards the remote end of the aerosol-forming substrate until the tip of the transfer tool forms the indentation in the aerosol-forming substrate and the narrowest end of the truncated hollow cone extends into the indentation formed in the aerosol-forming substrate.

15. Method according to claim 4, wherein the step of feeding an airflow directing truncated hollow cone towards the group of segments comprises feeding a continuous strand of truncated hollow cones, with adjacent truncated hollow cones of the strand being connected to each other, towards the group of segments and separating the foremost truncated hollow cone from the continuous strand of truncated hollow cones.

16. Method according to claim 4, wherein the group of segments is provided as a jointly wrapped component, the jointly wrapped component comprising a wrapper extending beyond the remote end of the aerosol-forming substrate, wherein either the wrapper extending beyond the remote end of the aerosol-forming substrate forms the air-intake tube or the air-intake tube is a separate individual segment wrapped by that portion of the wrapper extending beyond the remote end of the aerosol-forming substrate, and wherein the truncated hollow cone is inserted into the air-intake tube through the remote end of the air-intake tube.

17. Method for combining segments of a smoking article, the method comprising the steps of:

providing a group of segments, the group of segments comprising a heat source and an aerosol-forming substrate which are coaxially arranged in that sequence along a common central longitudinal axis, the aerosol-forming substrate being arranged such that a remote end of the aerosol-forming substrate faces away from the heat source while a near end of the aerosol-forming substrate abuts the heat source;

feeding an airflow directing truncated hollow cone having a widest end and a truncated narrowest end towards the group of segments by inserting a transfer tool having a tip into a truncated hollow cone such that the tip of the transfer tool projects from the truncated hollow cone through the narrowest end of the truncated hollow cone, and moving the transfer tool together with the truncated hollow cone towards the remote end of the aerosol-forming substrate until the tip of the transfer tool forms the indentation in the aerosol-forming substrate and the narrowest end of the truncated hollow cone extends into the indentation formed in the aerosol-forming substrate, wherein the truncated narrowest end of the truncated hollow cone is arranged to face the remote end of the aerosol-forming substrate, with a central longitudinal axis of the truncated hollow cone being aligned with the common central longitudinal axis of the group of segments; and moving the truncated hollow cone towards the remote end of the aerosol-forming substrate to abut the remote end of the aerosol-forming substrate or to extend into an indentation in the remote end of the aerosol-forming substrate.

18. Method for combining segments of a smoking article, the method comprising the steps of:

providing a group of segments, the group of segments comprising a heat source and an aerosol-forming substrate which are coaxially arranged in that sequence along a common central longitudinal axis, the aerosol-forming substrate being arranged such that a remote end of the aerosol-forming substrate faces away from the heat source while a near end of the aerosol-forming substrate abuts the heat source;

feeding an airflow directing truncated hollow cone having a widest end and a truncated narrowest end towards the group of segments in a manner such that the truncated narrowest end of the truncated hollow cone is arranged to face the remote end of the aerosol-forming substrate, with a central longitudinal axis of the truncated hollow cone being aligned with the common central longitudinal axis of the group of segments, wherein airflow directing truncated hollow cone is fed as a continuous strand of truncated hollow cones, with adjacent truncated hollow cones of the strand being connected to each other, towards the group of segments;

separating the foremost truncated hollow cone from the continuous strand of truncated hollow cone; and moving the truncated hollow cone towards the remote end of the aerosol-forming substrate to abut the remote end of the aerosol-forming substrate or to extend into an indentation in the remote end of the aerosol-forming substrate.

19. Method for combining segments of a smoking article, the method comprising the steps of:

providing a group of segments, the group of segments comprising a heat source and an aerosol-forming substrate which are coaxially arranged in that sequence along a common central longitudinal axis, the aerosol-forming substrate being arranged such that a remote end of the aerosol-forming substrate faces away from the heat source while a near end of the aerosol-forming substrate abuts the heat source;

arranging the common central longitudinal axis of the group of segments to extend perpendicular to a direction of transport of the group of segments;

feeding an airflow directing truncated hollow cone having a widest end and a truncated narrowest end towards the group of segments in a manner such that the truncated narrowest end of the truncated hollow cone is arranged to face the remote end of the aerosol-forming substrate;

aligning a central longitudinal axis of the truncated hollow cone with the common central longitudinal axis of the group of segments; and moving the truncated hollow cone towards the remote end of the aerosol-forming substrate to abut the remote end of the aerosol-forming substrate or to extend into an indentation in the remote end of the aerosol-forming substrate.

* * * * *